US005357917A

United States Patent [19]

Everts

[11] Patent Number: 5,357,917

[45] Date of Patent: Oct. 25, 1994

[54] STAMPED CAM FOLLOWER AND METHOD OF MAKING A STAMPED CAM FOLLOWER

[75] Inventor: Robert G. Everts, Chandler, Ariz.

[73] Assignee: Ryobi Outdoor Products, Inc., Chandler, Ariz.

[21] Appl. No.: 21,496

[22] Filed: Feb. 23, 1993

[51] Int. Cl.[5] ..... F01L 1/18

[52] U.S. Cl. ..... 123/90.39; 123/90.41; 123/90.44; 123/90.51; 74/519; 74/559

[58] Field of Search ..... 123/90.22, 90.23, 90.39, 123/90.41, 90.42, 90.44, 90.48, 90.51; 74/519, 569, 559

[56] References Cited

U.S. PATENT DOCUMENTS

| | | | |
|---|---|---|---|
| 1,404,183 | 1/1922 | Augustine | 123/90.39 |
| 2,980,089 | 8/1959 | Sampietro | 123/90.23 |
| 3,418,985 | 12/1968 | Hirose | 123/90.39 |
| 4,380,216 | 4/1983 | Kandler | 123/90.65 |
| 4,510,897 | 4/1985 | Hatz et al. | 123/90.48 |
| 4,662,323 | 5/1987 | Moriya | 123/90.23 |
| 4,716,861 | 1/1988 | Fujikawa et al. | 123/90.2 |
| 4,736,717 | 4/1988 | Fujikawa et al. | 123/90.2 |
| 4,872,429 | 10/1989 | Anderson et al. | 123/90.44 |
| 5,054,440 | 10/1991 | Kadokawa | 123/90.51 |
| 5,176,116 | 1/1993 | Imagawa et al. | 123/90.37 |
| 5,267,536 | 12/1993 | Imagawa et al. | 123/90.23 |
| 5,293,847 | 3/1994 | Hoffman et al. | 123/90.23 |

FOREIGN PATENT DOCUMENTS 338741 5/1992 Japan .

OTHER PUBLICATIONS

"The Little Engine That Could," by Judith A. Gunther, Mar., 1993 issue of Popular Science.

*Primary Examiner*—E. Rollins Cross
*Assistant Examiner*—Weilun Lo
*Attorney, Agent, or Firm*—Brooks & Kushman

[57] ABSTRACT

A follower for translating rotational motion of a cam into reciprocal motion of an intake or exhaust valve is disclosed. The follower comprises a first portion adapted to be pivotably mounted on a follower shaft and a second portion adapted to contact a cam surface. The first and second portions form a generally V shape. The first portion includes a bottom and a pair of side walls connected to the bottom. Each of the side walls has a hole therethrough, and the holes are coaxially aligned to accept the follower shaft. The second portion includes a first end connected to the first portion and a second distal end which contacts the cam surface. Also disclosed is a method of making a follower from common sheet metal.

9 Claims, 3 Drawing Sheets 110
124
126

112
114
116
118
120
122
124
126
128
130
132
134

118
120
128
130
134
136

18
44
46
48
50
52
56
58
59
60
62
64
66
68
70
128

112
114
116
118
120
122
124
126
134

112
114
116
118
120
122
124
126
132

STAMPED CAM FOLLOWER AND METHOD OF MAKING A STAMPED CAM FOLLOWER

TECHNICAL FIELD

This invention relates to cam followers for internal combustion engines, and more particularly to a V-shaped follower which is formed from sheet metal.

BACKGROUND ART

Small internal combustion four cycle engines typically include a cam gear and a pair of cam lobes mounted on a camshaft. The cam gear meshes with a crankgear mounted on a crankshaft, thereby rotating the camshaft in timed relation to the engine cycle. Each rotating cam lobe reciprocates a push rod, which in turn acts on a rocker arm to alternate an intake valve or an exhaust valve between open and closed positions. In the case of an overhead cam type engine, the rocker arms normally act directly between the cam lobes and the valves.

Less common constructions for actuating the intake and exhaust valves have also been proposed in which V-shaped or frog-leg-shaped followers bear directly against a cam surface. For example, U.S. Pat. No. 4,736,717 to Fujikawa et al. discloses a four-cycle engine having a pair of bell cranks fit onto separate pivot shafts. One arm of each bell crank follows a cam surface, while another arm contacts the lower end of a valve stem. Also, U.S. Pat. No. 4,510,897 to Hatz et al. discloses a mechanism for actuating the valve rockers of an internal combustion engine. The mechanism includes a pair of cam followers, each of which engages a cam surface and a push rod.

The followers utilized in internal combustion engines such as those discussed above are typically cast or forged. While these processes produce workable parts, they are relatively time consuming and costly. It would be advantageous to devise a method of making a follower by a less expensive process, for instance forming the follower from common sheet metal.

SUMMARY OF THE INVENTION

The present invention is a follower for translating rotational motion of a cam into reciprocal motion of an intake or exhaust valve. The follower comprises a first portion adapted to be pivotably mounted on a follower shaft and a second portion adapted to contact a cam surface. The first and second portions form a generally V shape. The first portion includes a bottom and a pair of side walls connected to the bottom. Each of the side walls has a hole therethrough, and the holes are coaxially aligned to accept the follower shaft. The second portion includes a first end connected to the first portion and a second distal end which contacts the cam surface.

The present invention also includes a method of making a follower for a cam. The method comprises providing a thin sheet, and punching an elongated blank from the sheet, the blank having a first portion, a second portion, and an interconnection portion interconnecting the first portion and the second portion. A first hole and a second hole are punched through the first portion of the blank on opposite sides of a longitudinal centerline of the blank. Then, the blank is deformed so that the first and second holes are in coaxial alignment. Finally, the blank is bent such that the first and second portions of the blank form a generally V shape.

Accordingly, it is an object of the present invention to provide a follower of the type described above for translating rotational motion of a cam lobe into reciprocal motion of an intake or exhaust valve.

Another object of the present invention is to provide a follower of the type described above which can be formed from common sheet metal.

Another object of the present invention is to provide an apparatus for actuating an intake valve and an exhaust valve which includes a single cam lobe and a pair of V-shaped followers pivotably suspended on a single pivot.

Still another object of the present invention is to provide a method of the type described above for making a follower from common sheet metal.

These and other objects, features, and advantages of the present invention are readily apparent from the following detailed description of the best mode for carrying out the invention when taken in conjunction with the accompanying drawings.

Figures 3, 6A, 6B, 6C, 7, 8:
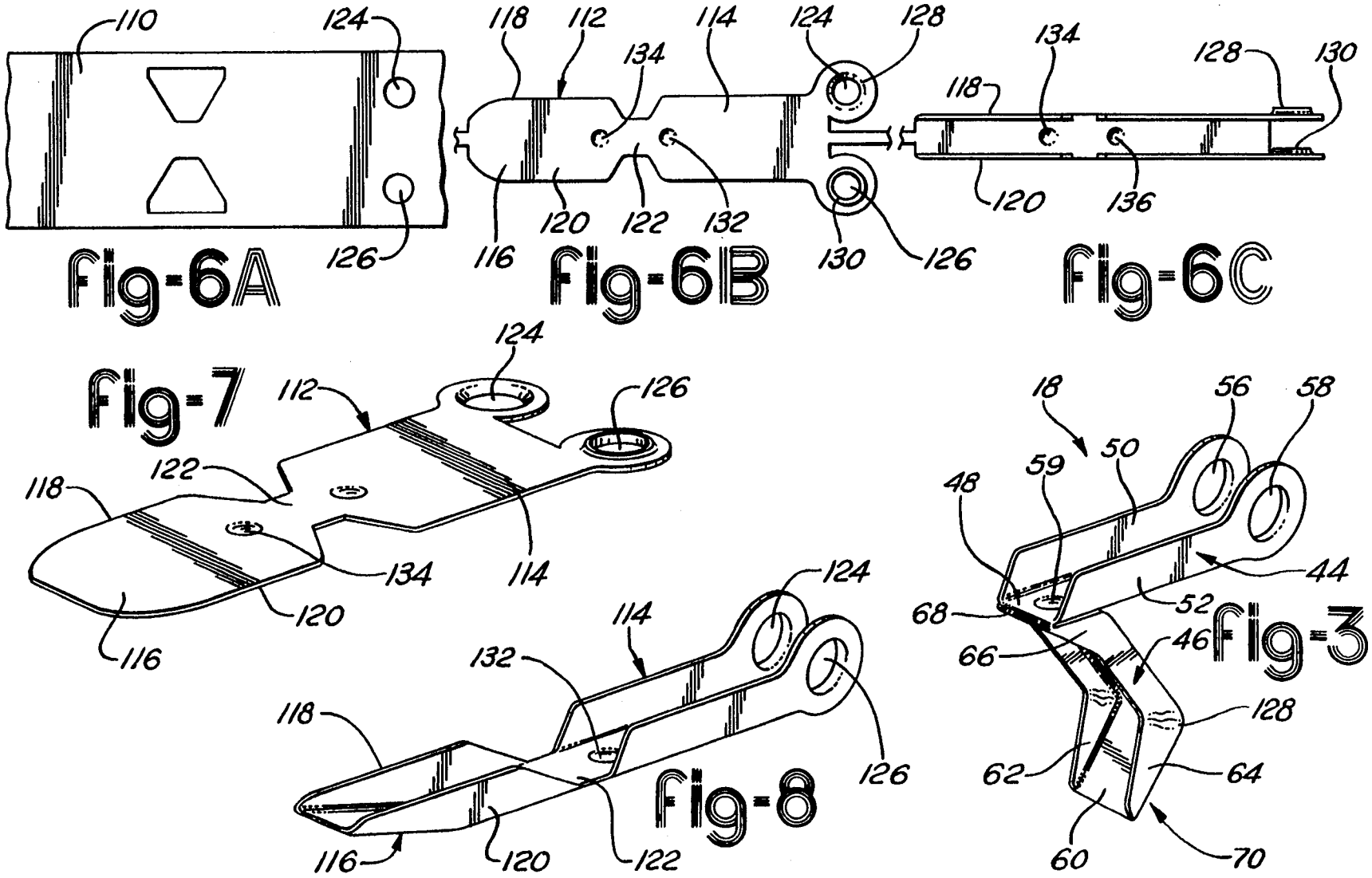
FIG. 3 is a perspective view of a follower according to the present invention.

FIGS. *6a–6c* are a series of plan views showing a stamping operation for forming the cam followers from a section of sheet metal stock;

FIG. 7 is a perspective view of a blank used in forming the cam follower; and FIG. 8 is another perspective view of the blank used in forming the cam follower.

BEST MODE FOR CARRYING OUT THE INVENTION

Figure 1:
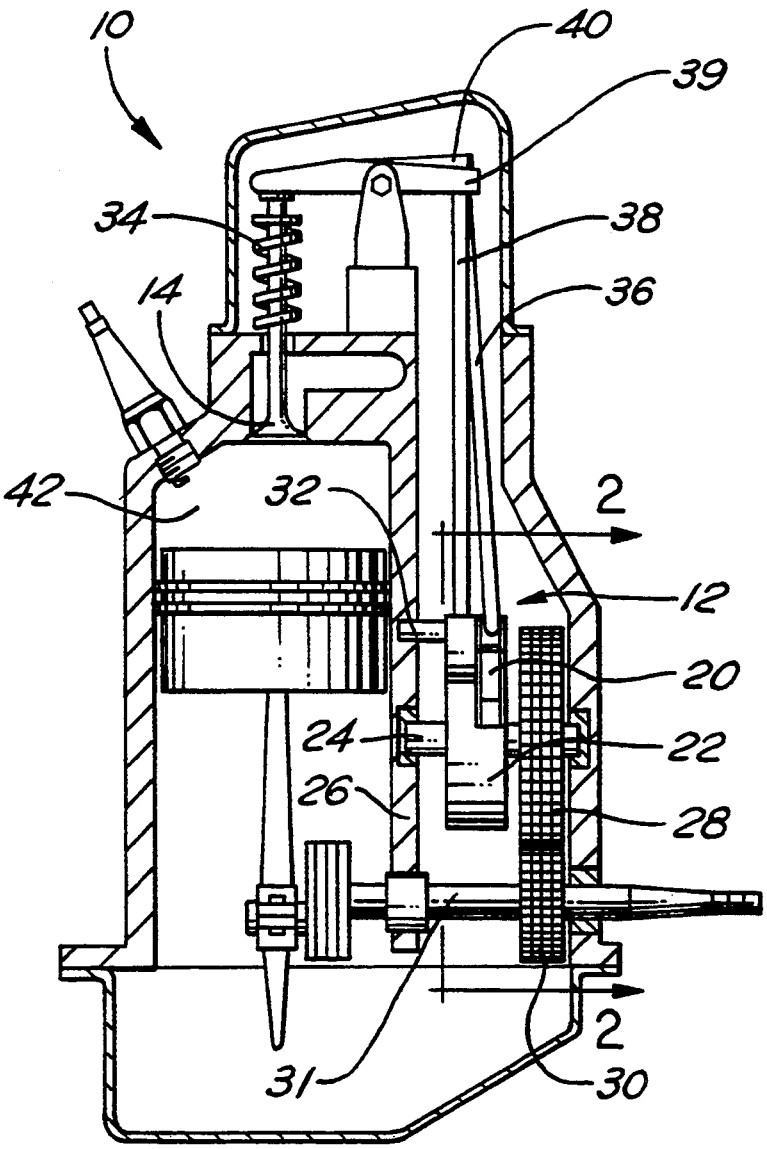
FIG. 1 is a cross sectional view of a small internal combustion engine having a pair of cam followers according to the present invention.
Figure 2:
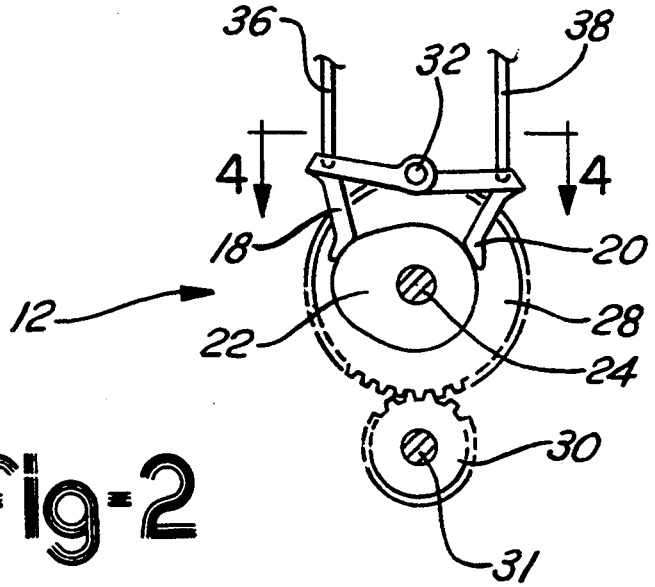
FIG. 2 is a side view of the followers and a cam lobe taken along line 2—2 in FIG. 1.

With reference to the drawings, the preferred embodiments of the present invention will be described. FIGS. 1 and 2 show a one cylinder four cycle internal combustion engine 10 having an apparatus 12 according to the present invention for actuating an intake valve 14 and an exhaust valve (not shown) of the engine 10. The appartus 12 comprises a pair of followers 18 and 20 which interact with a single rotatable cam lobe 22.

The cam lobe 22 is mounted on a camshaft 24, which in turn is mounted to an engine block 26. The cam lobe 22 is fixed against rotation relative to a cam gear 28, which meshes with and is rotated by a crankgear 30 mounted on a crankshaft 31. The followers 18 and 20 are preferably pivotably mounted on a follower shaft 32, which extends generally parallel to the camshaft 24 and is fixedly mounted in the engine block 26. The followers 18 and 20 thus pivot on the follower shaft 32 in well known fashion as the cam lobe 22 rotates.

The intake valve 14 and the exhaust valve are normally biased to a seated or closed position by springs 34. As the followers 18 and 20 pivot on the follower shaft 32, they respectively reciprocate push rods 36 and 38. The push rods 36 and 38 extend up to and cooperate with rocker arms 39 and 40, which alternately actuate the intake valve 14 and the exhaust valve, respectively, to conventionally supply a fuel-air mixture to the cylinder 42 and to evacuate the byproducts of combustion from the cylinder.

FIG. 3 shows one of the followers 18 according to the present invention. The follower 18 comprises a first portion 44 and a second portion 46 formed in a generally frogleg or V shape. The first portion 44 of each follower has a generally U-shaped cross-section including a bottom 48 and a pair of parallel spaced apart side walls 50 and 52 connected to the bottom 48. The side walls 50 and 52 extend generally perpendicular to and are integral with the bottom 48. Bearing holes 56 and 58 are formed through each of the side walls 50 and 52, respectively, and accept the follower shaft 32. The bottom 48 also has a dimple 59 spaced from the holes 56 and 58. The dimple 59 is sized to receive a sperical rod end such as the end of push rods 36 or 38. The dimple 59 may include an aperture therethrough (not shown) to allow oil to flow through the follower 18 for better lubrication of the apparatus 10.

The second portion 46 of each follower similarly has a generally U-shaped cross-section including a bottom 60 and a pair of parallel spaced apart side walls 62 and 64. A first end 66 of the bottom 60 is connected to an interconnection portion 68, which in turn is connected to the first portion 44. A second distal end 70 of the bottom 60 is a wear surface adapted to contact the cam lobe 22, as shown in FIGS. 1 and 2, and is therefore preferably induction hardened or otherwise heat treated for this purpose.

Figure 4:
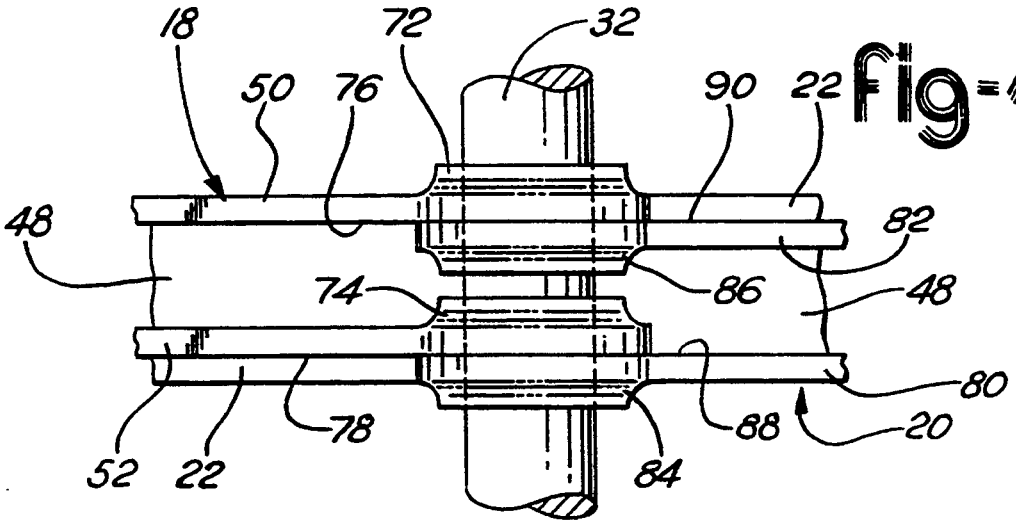
FIG. 4 is a top view taken along line 4—4 in FIG. 2 and showing the followers mounted on a follower shaft.

FIG. 4 shows the followers 18 and 20 mounted on the follower shaft 32. Rimmed edges 72 and 74 extend out from the holes 56 and 58 of the follower 18, respectively, while the opposite sides 76 and 78 of the side walls 50 and 52 are flat. Similarly, the follower 20 includes side walls 80 and 82, each of which has a rimmed edge 84, 86 formed opposite a flat side 88, 90 respectively.

The rimmed edges 72, 74, 84 and 86 provide a greater surface area for the follower shaft 32 to bear against than would a simple hole through each of the followers 18 and 20. At the same time, the flat sides 76 and 78 of the first follower 18 directly abut the flat sides 88 and 90 of the second follower 20, thereby minimizing the width of the followers as measured along the axis of the follower shaft 32. The diminished axial span of the followers 18 and 20 allows a correspondingly narrower cam lobe 22, and also allows the size of the engine to be narrowed to the same degree.

Figure 5:
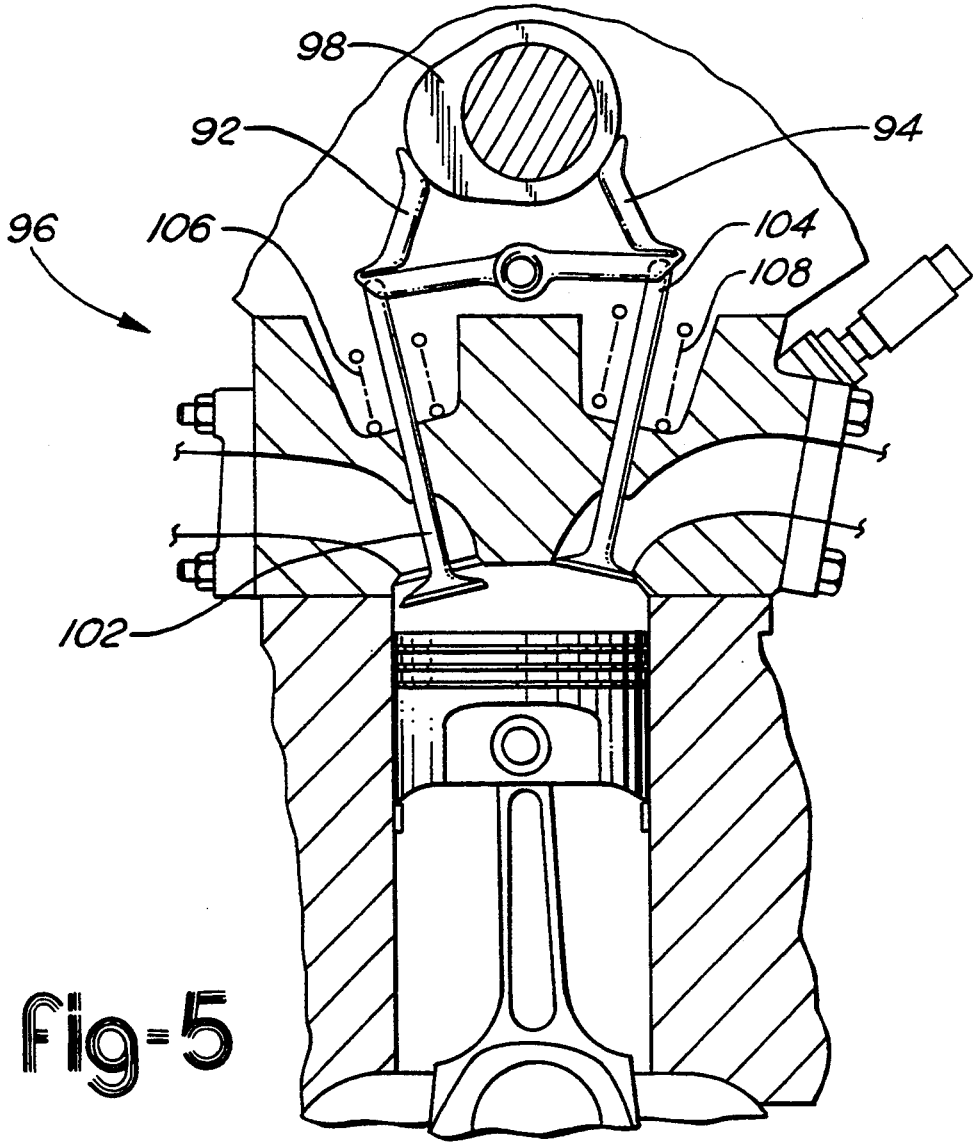
FIG. 5 is a cross sectional view of a portion of an overhead cam type small internal combustion engine having a pair of cam followers according to the present invention.

FIG. 5 shows followers 92 and 94 according to the present invention installed on an overhead type internal combustion engine 96. In this embodiment, the construction of the followers 92 and 94 is substantially the same as described above. However, in operation the rotation of a cam lobe 98 pivots the followers 92 and 94 on a follower shaft 100. The followers 92 and 94 in turn directly operate exhaust valve 102 and intake valve 104 against the closing force of springs 106 and 108. As in the embodiment previously shown and described, the present invention provides a single cam lobe for driving both the intake and the exhaust valves in a four cycle engine, and a pair of V-shaped cam followers pivotally supported on a common shaft.

FIGS. 6–8 show a method of making a V-shaped cam follower such as the ones described above. As shown in FIG. 6*a*, a thin sheet 110, preferrably of cold rolled steel or common sheet metal stock, is initially provided. As shown in FIGS. 6*a* and 6*b*, an elongated, hourglass-shaped outline or blank 112 is then punched from the sheet 110. The blank 112 has a first portion 114, a second portion 116 including a pair of ends 118 and 120 on opposite sides of a longitudinal centerline of the blank, and an interconnection portion 122 interconnecting the first portion 114 and the second portion 116.

First and second bearing holes 124 and 126 are punched through the first portion 114 of the blank 112 on opposite sides of the longitudinal centerline, and preferably progressively stamped to draw the rimmed edges 128 and 130. Push rod dimples 132 and 134 are then formed in the first and second portions of the blank. As discussed above, the bottom of each dimple may include a hole to facilitate oil flow for lubrication purposes. The dimple 134 in the second portion 116 of the blank is formed projecting upwardly out of the sheet so that it will nest with first dimple 132 when the first and second portions 114 and 116 are folded with respect to each other.

As shown in FIGS. 6*c*, 7 and 8, the blank is next deformed so that the ends 118 and 120 of the second portion 116 are generally parallel, and the first and second bearing holes 124 and 126 are in coaxial alignment. Thereafter, the blank is broken away from the sheet.

Preferably after the blank has been broken away, the interconnection portion 122 of the blank is bent generally perpendicularly to the longitudinal centerline such that the first and second portions 114 and 116 of the blank form a generally V shape. Finally, the second portion 116 of the blank is bent generally transversely to the longitudinal centerline, leaving the ripples 128 shown in FIG. 3. The second portion 116 of the blank is preferably induction hardened, since it is adapted to bear against a cam surface such as the eccentric periphery of a cam lobe.

It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

What is claimed is:

1. A cam follower comprising:

a first portion of generally U-shaped cross-section including a bottom and a pair of parallel spaced apart side walls connected to the bottom, each of the side walls having a hole therethrough, the holes being in coaxial alignment and adapted to accept a shaft; and a second portion including a first end connected to the first portion and a second distal end adapted to contact a cam surface;

the first and second portions forming a generally V shape.

2. The follower of claim 1 wherein the first portion has a dimple formed therein spaced from the holes and sized to receive a spherical rod end.

3. The follower of claim 1 wherein the first and second portions are formed from cold rolled steel.

4. The follower of claim 3 wherein the second end of the second portion is induction hardened.

5. The follower of claim 1 wherein the second portion has a generally U-shaped cross-section including a bottom and a pair of parallel spaced apart side walls.

6. The follower of claim 1 wherein the second portion is formed in a generally V shape.

7. Apparatus for actuating an intake valve and an exhaust valve in an internal combustion engine, the apparatus comprising:

a rotatable cam lobe;

a follower shaft; and a pair of followers, each follower including:

a first portion including a bottom and a pair of side walls connected to the bottom, the bottom having a dimple, each of the side walls having a hole through which the follower shaft is accepted, and a second portion including a bottom and a pair of side walls, the bottom having a first end connected to the first portion and an induction hardened second distal end in contact with the cam lobe, the first end having a dimple which nests with the dimple in the first portion, the first and second portions forming a generally V shape.

8. The apparatus of claim 7 wherein the holes through each follower have a rimmed edge.

9. The apparatus of claim 7 wherein the followers are formed from cold rolled steel.

* * * * *